United States Patent [19]

Ushijima

[11] Patent Number: 4,820,150

[45] Date of Patent: Apr. 11, 1989

[54] WALKING BEAM TYPE REHEATING FURNACE

[75] Inventor: Shigemi Ushijima, Nagaokakyo, Japan

[73] Assignee: Chugai Ro Co., Ltd., Osaka, Japan

[21] Appl. No.: 89,063

[22] Filed: Aug. 25, 1987

Related U.S. Application Data

[63] Continuation of Ser. No. 888,432, Jul. 23, 1986, Pat. No. 4,741,695.

[30] Foreign Application Priority Data

Aug. 9, 1985 [JP] Japan ..... 60-176077

[51] Int. Cl.[4] ..... F27B 9/14

[52] U.S. Cl. ..... 432/121; 432/122; 432/126; 432/234; 414/156; 198/774

[58] Field of Search ..... 432/121–126, 432/133; 414/156, 198; 198/774

[56] References Cited

U.S. PATENT DOCUMENTS

| | | | |
|---|---|---|---|
| 3,304,210 | 2/1967 | Lofstrom | 432/126 |
| 3,512,628 | 5/1970 | Keough | 432/122 |
| 3,749,550 | 7/1973 | Suydam | 432/234 |
| 3,806,309 | 4/1974 | Laws et al. | 432/126 |
| 3,820,946 | 6/1974 | Miyoshi et al. | 432/121 |
| 3,887,064 | 6/1975 | Brockmann | 432/122 |
| 4,025,298 | 5/1977 | Tokitsu | 432/122 |
| 4,407,404 | 10/1983 | Rise et al. | 198/774 |
| 4,427,371 | 1/1984 | Unks | 432/122 |

*Primary Examiner*—Henry C. Yuen

*Attorney, Agent, or Firm*—Wenderoth, Lind & Ponack

[57] ABSTRACT

A walking beam type reheating furnace which is provided with a furnace housing, stationary beams fixedly mounted in the furnace housing, first movable beams arranged on the charge side in the furnace housing, second movable beams arranged separately from the first movable beams on the discharge side in the furnace housing and a steel workpiece transfer device capable of transferring a steel workpiece which is placed in a zone where the first movable beams are located to a predetermined position in the vicinity of a separating portion of the first and second movable beams by passing the steel workpiece over the stationary beams and the first movable beams, wherein the first and second movable beams can be independently driven from each other.

7 Claims, 2 Drawing Sheets

WALKING BEAM TYPE REHEATING FURNACE

This application is a continuation of Ser. No. 888,432, filed July 23, 1986, now U.S. Pat. No. 4,741,695.

BACKGROUND OF THE INVENTION

The present invention generally relates to a reheating furnace and more particularly, to a walking beam type reheating furnace wherein hot or cold steel workpieces such as slabs, blooms, billets or the like can be heated not only separately, but also in a state where they are mixed together with each other.

The walking beam type reheating furnace generally has functions of transferring the workpieces which have been bloomed or have been discharged from a continuous casting machine towards a discharge side of the furnace in steps by being displaced on stationary beams and on movable beams alternately through repeating rectangular motions of the movable beams which are disposed in a longitudinal direction of the furnace, while the workpieces are heated up to a target temperature by burners and thereafter, they are transferred from a discharge port of the furnace towards a hot rolling machine for an after-process thereon.

Meanwhile, it is desirable, from the viewpoint of saving energy, to charge the workpieces into the furnace from a charge port defined at an intermediate portion thereof in the case of hot workpieces or from another charge port defined at the charge end portion thereof in the case of cold workpieces.

One type of continuous reheating furnace for conducting the above described heating process is disclosed in, for example, Japanese Patent Laid-Open Publication Tokkaisho No. 58-104114, wherein a walking hearth type transfer means is employed for transferring the workpieces and there is an opening in a side wall at the intermediate portion of the furnace for charging the hot workpieces therethrough. Furthermore, each of the hot workpieces is charged into the furnace by a pusher located outside the furnace and is subsequently heated up, while being transferred towards a discharge side of the furnace in steps through the rectangular motions of the walking hearth. In this kind of reheating furnace, however, the fact that the hot workpieces are charged into the furnace by the pusher undesirably results in trouble with respect to the transfer of the workpieces in that not only they are damaged at the lower surface thereof by getting in contact with the upper surface of the hearth, but also they are charged out of position in the furnace or they are obliquely transferred therein.

Moreover, it is necessary to provide such a charging line for exclusive use as a hot workpiece charging device in addition to a cold workpiece charging one and as a result, the installation space required therefor tends to be large with an increasing cost of equipment.

On the other hand, another type of continuous reheating furnaces is disclosed in, for example, Japanese Patent Laid-Open Publication Tokkaisho No. 55-134125, wherein a walking beam type transfer means is employed for transferring the workpieces and there is an opening a top wall at the intermediate portion of the furnace for charging the hot workpieces therethrough. Each of the hot workpieces is charged into the furnace by being hung down by a fork device or the like disposed above the opening and is subsequently heated up, while being transferred towards a discharge side of the furnace in steps through the rectangular motions of the walking beams. In this kind of reheating furnace, although the hot workpieces can be freed from the damage at the lower surface thereof due to the fact that they are not charged into the furnace by the pusher, there has been some problem related to security of safety or efficient workability since not only is a seal device for sealing the opening or a hanging device for hanging down the hot workpiece arranged on the furnace inevitably on a large scale, but also the atmosphere which is high in temperature spouts from the opening at the time when the hot workpiece is charged.

In addition, either type of the aforementioned reheating furnaces does not have sufficient functions for coping with a variety of treatments for the workpieces.

SUMMARY OF THE INVENTION

Accordingly, an essential object of the present invention is to provide an improved walking beam type reheating furnace which is simple in construction and which can be reduced in installation space thereof, wherein hot and cold steel workpieces may be combined with each other and subjected to heat treatment together.

Another important object of the present invention is to provide a walking beam type reheating furnace of the above described type which is advantageous in energy saving.

In accomplishing these and other objects, according to one preferred embodiment of the present invention, there is provided a walking beam type reheating furnace having a furnace housing, stationary beams fixedly mounted in the furnace housing, first movable beams arranged on the charge side in the furnace housing, second movable beams arranged separately from the first movable beams on the discharge side in the furnace housing and workpiece transfer devices capable of transferring a workpiece which is placed in a zone where the first movable beams are located to a predetermined position in the vicinity of a separating portion of the first and second movable beams by passing the workpiece over the stationary beams and the first movable beams, wherein the first and second movable beams can be independently driven from each other.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
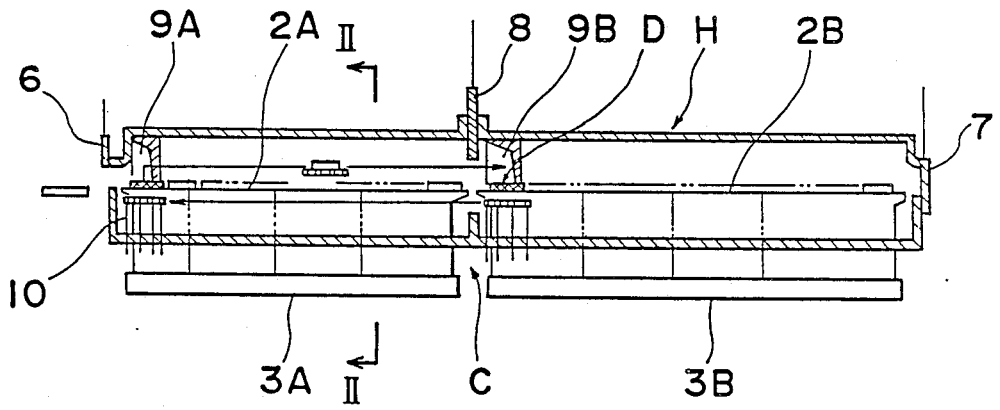
FIG. 1 is a schematic sectional view of a walking beam type reheating furnace of the present invention according to one preferred embodiment thereof.

Before the description of the present invention proceeds, it is to be noted that like parts are designated by like reference numerals throughout the accompanying drawings.

Figure 2:
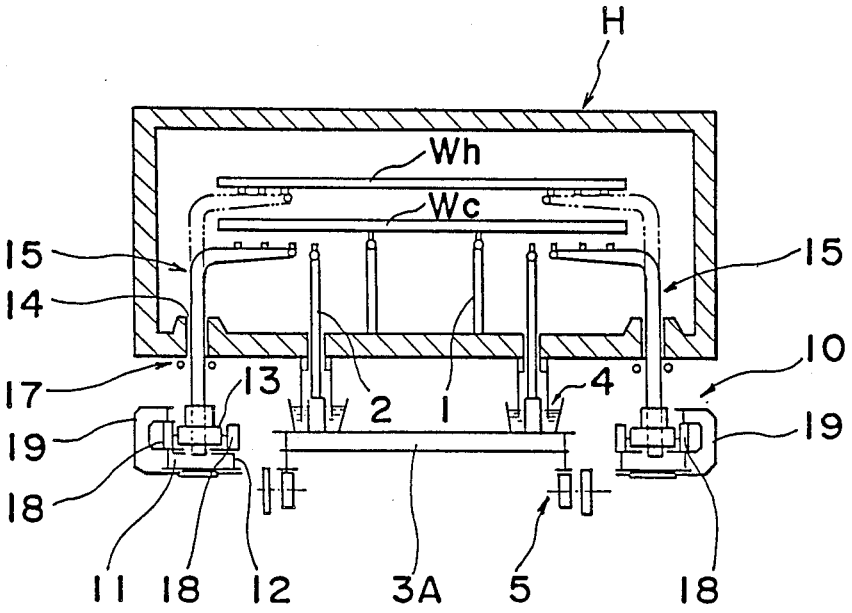
FIG. 2 is a cross section taken along the line II—II in FIG. 1.

Referring now to the drawings, there is shown in FIGS. 1 and 2, a walking beam type reheating furnace according to one preferred embodiment of the present invention, which is generally provided with a furnace housing H, a plurality of stationary and movable beams 1 and 2, respectively and workpiece transfer devices 10.

As shown in FIG. 1, the movable beams 2 are separated into first and second movable beams, that is, the movable beams 2A on the charge side e.g. in a first half zone of the furnace and those 2B on discharge side e.g. in a latter half zone thereof, and each of them is securely connected, through a known seal means 4, to either of movable frames 3A and 3B located under a floor of the furnace and is caused to be driven independently or together with each other by a vertical drive unit 5 and a horizontal drive unit (not shown), each of which units is of a conventionally known type.

The walking beam type reheating furnace of the present invention is further provided with a charge door 6 and an exhaust gas port 9A at the charge end portion of the furnace, a discharge door 7 at the discharge end portion of the furnace, and an intermediate door 8 and an exhaust gas port 9B at the central portion thereof.

Furthermore, as shown in FIG. 2, each of the workpiece transfer devices 10 includes a lift beam 11 capable of moving up and down by a vertical drive unit (not shown) and arranged on each side of the movable frame 3A, a carrier 13 capable of reciprocably moving on a pair of rails 12 securely mounted on the lift beam 11 between a charge port of the furnace and a position in the vicinity of a separating portion C of the first and second movable beams 2A and 2B, and a plurality of, for example, four workpiece supporting members 15, each composed of a stay which has a shape generally similar to that of a figure 'L' and protrudes upwardly through one of a plurality of longitudinally extending openings 14 defined in the floor of the furnace in a longitudinal direction thereof, with each of the supporting members 15 being mounted on the carrier 13 on each side of the furnace and having an upper free end which is bent inwardly and facing an oppositely disposed free end of another workpiece supporting member, as shown in FIG. 2.

Meanwhile, each carrier 13 is provided with a plurality of wheels 18, some of which are held by a holding member 19, and the openings 14 of the furnace are sealed by air-seal means 17 which are arranged on the lower surface of the floor of the furnace.

Furthermore, each of the aforementioned supporting members 15 moves up and down between a position wherein the upper surface of the supporting member 15 is located below a supporting surface of the stationary beams 1 and a position wherein the lower surface of the supporting member 15 is located above the upper surface of a workpiece W supported on the stationary beams 1 or on the movable beams 2A on the charge side.

Figure 4:
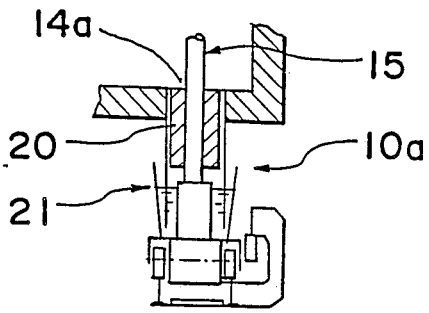
FIG. 4 is a sectional view of the workpiece transfer device which particularly shows a modification thereof.

Meanwhile, as shown in FIG. 4, the workpiece transfer device 10a may be sealed by a water seal device 21 instead of the air seal device 17, and in addition, it is provided with a plugging piece 20 fixedly adhered to the supporting member 15 at the openings 14a in the floor of the furnace.

Figure 5:
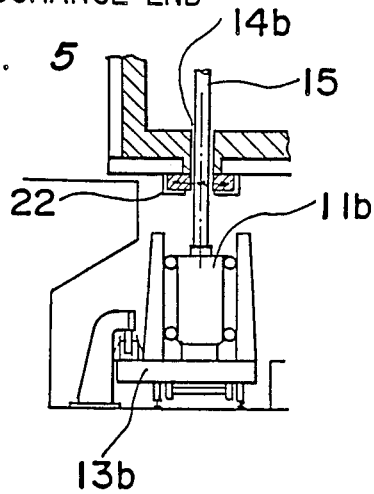
FIG. 5 is a sectional view of the workpiece transfer device which shows another modification thereof.

Moreover, it may be so modified that as shown in FIG. 5, the atmosphere can be prevented from entering the furnace and the radiation loss of the heat can be reduced by arranging a plurality of covers 22 which are divided into small sized pairs of covers on the external surface of the floor of the furnace which are movable towards and away from each other for covering the openings 14b, and by opening and shutting the covers 22 sequentially as the supporting member 15 moves in the longitudinal direction. At this moment, the lift beam 11b moves up and down on a carrier 13b by a vertical drive unit.

Figure 3:
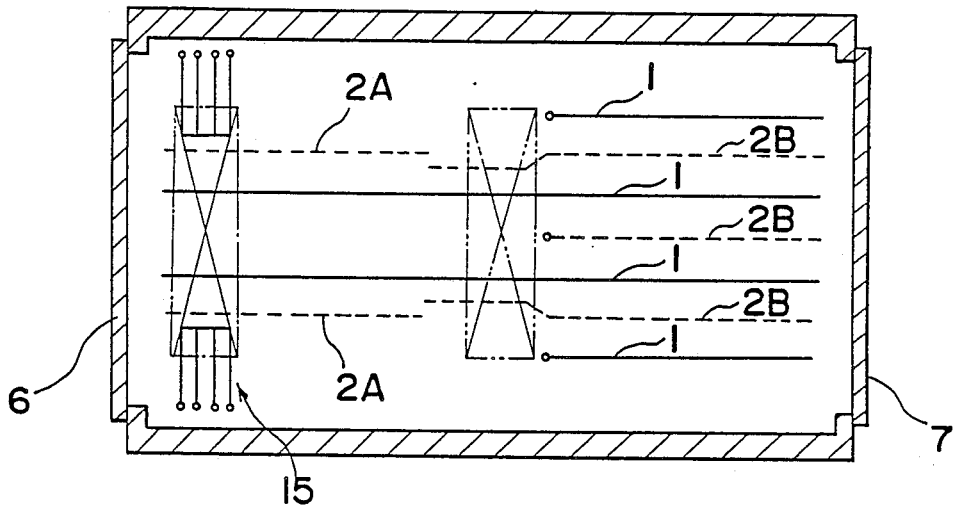
FIG. 3 is a top plan view showing an arrangement of first and second movable beams, workpiece supporting members and stationary beams.

FIG. 3 shows an arrangement of the first and the second movable beams 2A and 2B, the workpiece supporting members 15 and the stationary beams 1. On the other hand, the relationship between the separating portion C of the first and the second movable beams 2A and 2B, and the temperature of the workpiece W or within the furnace is indicated in FIG. 6, wherein when a cold workpiece Wc charged into the furnace has reached the separating portion C, it is caused to be approximately equal in temperature to a hot workpiece Wh to be charged.

Subsequently, the operation of the walking beam type reheating furnace having the above described construction will be explained hereinafter.

In the first place, when only the cold workpiece Wc is subjected to a continuous heat treatment, a damper (not shown) for the exhaust gas port 9A on the charge side is opened and a damper (not shown) for the exhaust gas port 9B at the central portion C of the furnace is shut, and thereafter an intermediate door 8 is opened.

Figure 6:
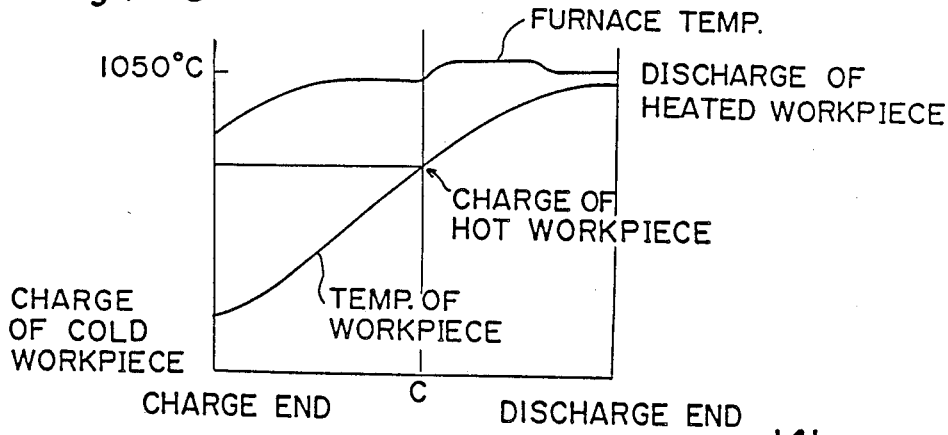
FIG. 6 is a graph showing a relationship between the temperature in the furnace or of the workpiece, and a hot workpiece transfer position.

Furthermore, the cold workpiece Wc which has been charged in position on the stationary beams 1 is transferred within the furnace by the first and the second movable beams 2A and 2B which are driven in combination with each other and is discharged from a discharge opening after having been heated up in accordance with a heat curve as shown in FIG. 6. At this moment, the workpiece transfer devices 10 having the supporting members 15 are kept in stand-by condition and at the lowermost position thereof on the charge end of the furnace.

In the second place, when only the hot workpiece Wh is subjected to the continuous heat treatment, the exhaust gas ports 9A and 9B are shut and opened, respectively.

When the hot workpiece Wh has been charged in position on the stationary beams 1, the supporting members 15 are raised so as to lift the hot workpiece Wh upwardly, while it is supported by the supporting members 15 disposed on respective sides of the furnace. Thereafter, the carriers 13 are caused to travel to a hot workpiece transfer position D which is located on the discharge side of the furnace and in which the supporting members 15 are lowered so as to place the hot workpiece Wh on the stationary beams 1. Subsequently, the hot workpiece Wh is conveyed within the discharge side of the furnace towards the discharge opening through the rectangular movement of the second movable beams 2B, and the hot workpiece Wh is discharged from the discharge opening after having been heated up in accordance with a heat curve as shown in FIG. 6.

Hereupon, both of the charge door 6 and the intermediate door 8 are opened only when the hot workpiece Wh is charged.

Meanwhile, upon completion of the above described process, the supporting members 15 kept at the lowermost position thereof are caused to move towards the charge end of the furnace again and are held in stand-by condition, until a subsequent hot workpiece Wh is charged so that the aforementioned process is carried out repeatedly.

In the course of the above described operation, when the hot workpiece Wh is prevented from being discharged from the furnace due to a rearrangement of rolls in a hot rolling machine or a breakdown thereof, a zone where the first movable beams 2A are located is used as a stock zone.

Moreover, in the case where the hot workpieces Wh are sent from a continuous casting machine when they are directly charged in position on the stationary beams 1 in the furnace without being temporarily stored in a yard for workpieces as in the conventional practice, each of them is placed respectively, through the sequential movement of the supporting members 15 as stated hereinbefore, from the discharge end towards the charge end on the stationary beams 1 in the zone where the first movable beams 2A are arranged therewith. Thereafter, upon selection of the hot workpieces Wh on the stationary beams 1 in order according to a hot rolling schedule, they are sequentially transferred to the hot workpiece transfer position D and are further transferred towards the discharge side by the second movable beams 2B in such a manner as described above. In this case, the exhaust gas port 9a or 9B is selectively opened or shut in accordance with the conditions of the hot workpieces Wh in the furnace.

In the third place, the case where the cold and the hot workpieces are combined with each other and subjected to a heat treatment will be explained hereinafter.

When the cold workpieces Wc are subjected to the heat treatment in the midst of the treatment for the hot workpieces Wh in a zone where the second movable beams 2B are located, the hot workpieces Wh which have been charged on the stationary beams 1 are transferred to the hot workpiece transfer position D by the supporting members 15 and towards the discharge side in turns by the second movable beams 2B as stated above.

On the other hand, each cold workpiece Wc is charged on the stationary beams 1 in the intervals of the aforementioned charge of the hot workpiece Wh and is sequentially transferred to the discharge side by the first movable beams 2A. At this moment, the first and the second movable beams 2A and 2B are driven independently from each other.

Upon subsequent charge of another hot workpiece Wh, it is transferred to the hot workpiece transfer position D by the supporting members 15 in such a manner as mentioned above after having passed over the cold workpieces Wc which are placed in the zone where the first movable beams 2A are located. Thus, when the cold workpieces Wc are placed throughout the aforementioned zone, the first and the second movable beams 2A and 2B are driven in combination with each other.

In this kind of heat treatment, the exhaust gas port 9A is opened at the same time when the cold workpiece Wc is initially charged into the furnace and the exhaust gas port 9B is shut.

Furthermore, in the case where the hot workpieces Wh are subjected to the heat treatment in succession after that for the cold workpieces Wc, the exhaust gas ports 9B and 9A are opened and shut respectively, immediately after the last cold workpiece Wc has passed the hot workpiece transfer position D. Thereafter, in the similar manner as described above, each of the hot workpieces Wh charged on the stationary beams 1 is transferred to the hot workpiece transfer position D by the supporting members 15 and is further transferred towards the discharge side in turns by the second movable beams 2B.

That is, the cold and the hot workpieces Wc and Wh are heated up together in the zone where the second movable beams 2B are located.

In addition, in the case where the hot workpieces Wh are subjected to the heat treatment in succession after that for the cold workpieces Wc in a state where the cold workpieces Wc are placed within the entire furnace, the hot workpieces Wh charged on the stationary beams 1 are sequentially transferred towards the discharge side by the first movable beams 2A and simultaneously with this process, the hot workpieces Wh are charged subsequently after the cold workpieces Wc until the first hot workpiece Wh reaches the separating portion C.

When the first hot workpiece Wh has reached the end on the discharge side of the first movable beams 2A, the exhaust gas ports 9B and 9A are opened and shut, respectively and thereafter, the hot workpieces Wh placed on the first movable beams 2A are sequentially and selectively transferred to the hot workpiece transfer position D by the workpiece supporting members 15 in accordance with the hot rolling schedule.

In the above described embodiment, although the workpiece transfer device within the furnace is composed of the supporting members which are movable in a relationship parallel to the movable beams on the charge side, it may be so modified as to be composed of an overhead type transfer means wherein an opening portion is formed at the ceiling portion of the furnace, or a gantry type transfer means can be used wherein the supporting members 15 on respective sides of the furnace are integrally formed with each other.

Furthermore, it may be so modified that the movable beams 2A and/or 2B on the charge and/or the discharge sides are further divided.

As is clearly seen from the above description, since the walking beam type reheating furnace of the present invention is so constructed that the movable beams are divided into two parts, that is, the movable beams on the charge side and those on the discharge side, either of which can be driven independently from each other and there is arranged workpiece transfer devices therein which are capable of transferring the workpiece to a desired position in the vicinity of the portion dividing the movable beams by passing the workpiece over the movable beams on the charge side, it is not necessary to separately provide respective charge ports for the hot and the cold workpieces for exclusive use, thus resulting in that the walking beam type reheating furnace of the present invention wherein the hot and the cold workpieces may be subjected to the heat treatment simultaneously in a mixed state, can be manufactured through simple construction, with a marked reduction in the space required for the installation thereof.

Moreover, since the workpiece transfer devices are provided in the furnace, when the hot workpiece is subjected to the heat treatment, it can be rapidly transferred onto the movable beams on the discharge side and accordingly, the present invention is advantageous in saving energy due to the fact that the zone in the furnace where the movable beams on the charge side are located, is not substantially used during this occasion.

In addition, in the case where the hot workpiece is subjected to the heat treatment, the zone in the furnace where the movable beams on the charge side are located can be used as a stock zone, and in the case where the hot workpiece is subjected to the heat treatment according to a hot rolling schedule, the workpiece can be directly charged into the furnace without rearranging the workpieces preliminarily piled one upon another in the yard therefor as in the conventional case, and what is called 'the direct hot charge' can be materialized.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A walking beam type reheating furnace which comprises:

a furnace housing having a charge opening defined at one end thereof for charging a workpiece therethrough and a discharge opening defined at the other end thereof for discharging said workpiece therefrom, with an exhaust port for exhausting gas inside said housing being formed on the charge end of the furnace and a door being arranged on each of said openings;

a plurality of stationary beams extending in a longitudinal direction of the furnace;

a plurality of movable beams parallel to said stationary beams and extending in said longitudinal direction of the furnace, said movable beams being separated at least into first movable beams on the charge side of the furnace and second movable beams on the discharge side thereof, each of which movable beams is provided with a vertical and a horizontal drive unit;

workpiece transfer means for removing an individual workpiece from any position on said stationary beams and said first movable beams in the charge end of the furnace and moving the individual workpiece to a position in the vicinity of a separating portion of the furnace at which the first and the second movable beams are separated from each other in the longitudinal direction, said transfer means being movable vertically a distance sufficient to lift the individual workpiece above any other workpieces on the first movable beams and stationary beams in the charge end of the furnace and being movable longitudinally to move the individual workpiece over any other workpieces located in the charge end of the furnace during transfer of the individual workpiece to the separating portion of the furnace; and an intermediate door movable in a vertical direction and arranged on a top wall of the furnace at the separating portion of the first and the second movable beams, with an exhaust port being defined in a portion of the furnace containing the second movable beams and in the vicinity of said intermediate door;

wherein a workpiece can be transferred to said separating portion, while being supported on said workpiece transfer means in a zone where said first movable beams are located.

2. The walking beam type reheating furnace as claimed in claim 1, wherein said workpiece transfer means comprises a plurality of workpiece supporting members and said workpiece supporting members are L-shaped with free ends thereof extending in a direction perpendicular to said longitudinal direction.

3. The walking beam type reheating furnace as claimed in claim 2, wherein said workpiece transfer means comprises at least one pair of said L-shaped members having the free ends thereof facing each other with the first movable beams therebetween.

4. The walking beam type reheating furnace as claimed in claim 1, wherein said workpiece transfer means comprises a plurality of workpiece supporting members extending through respective longitudinally extending openings in the furnace, the furnace further including seal means for closing the longitudinally extending openings and allowing the workpiece supporting members to move vertically and longitudinally in the longitudinally extending openings.

5. The walking beam type reheating furnace as claimed in claim 4, wherein said seal means comprises an air seal.

6. The walking beam type reheating furnace as claimed in claim 4, wherein said seal means comprises a water seal.

7. The walking beam type reheating furnace as claimed in claim 4, wherein said seal means comprises a plurality of covers each of which is movable towards and away from another one of the covers.

* * * * *

UNITED STATES PATENT AND TRADEMARK OFFICE

CERTIFICATE OF CORRECTION

PATENT NO. : 4,820,150

DATED : April 11, 1989

INVENTOR(S) : Shigemi USHIJIMA

It is certified that error appears in the above—identified patent and that said Letters Patent is hereby corrected as shown below:

Title page:

Following line 75 insert [*] Notice: The portion of the term of this patent subsequent to May 3, 2005 has been disclaimed.

Signed and Sealed this

Twenty-third Day of January, 1990

*Attest:*

JEFFREY M. SAMUELS

*Attesting Officer*

*Acting Commissioner of Patents and Trademarks*